US006022158A

United States Patent [19]

Nakayama et al.

[11] Patent Number: 6,022,158

[45] Date of Patent: Feb. 8, 2000

[54] ROLL PAPER LOADING MECHANISM FOR PRINTER

[75] Inventors: Hiroyuki Nakayama, Shiojiri; Hideki Kawakami, Hata-machi; Toshiyuki Sasaki, Matsumoto; Masashi Fujikawa, Okaya, all of Japan

[73] Assignee: Seiko Epson Corporation, Tokyo, Japan

[21] Appl. No.: 09/194,484

[22] PCT Filed: Apr. 2, 1998

[86] PCT No.: PCT/JP98/01548

§ 371 Date: May 13, 1999

§ 102(e) Date: May 13, 1999

[87] PCT Pub. No.: WO98/43820

PCT Pub. Date: Oct. 8, 1998

[30] Foreign Application Priority Data

Apr. 2, 1997 [JP] Japan ..... 9-084236
Apr. 2, 1997 [JP] Japan ..... 9-084237

[51] Int. Cl.[7] ..... B41J 11/26; B41J 29/02; B41J 47/46

[52] U.S. Cl. ..... 400/613; 400/693; 101/93

[58] Field of Search ..... 101/93, 225, 228; 400/611, 613, 692, 693; 235/58 CF

[56] References Cited

U.S. PATENT DOCUMENTS

| | | | |
|---|---|---|---|
| 4,729,681 | 3/1988 | Moser | 400/613.2 |
| 5,672,020 | 9/1997 | Leonard et al. | 400/690.4 |
| 5,887,999 | 3/1999 | Smith et al. | 400/621 |

FOREIGN PATENT DOCUMENTS

| | | |
|---|---|---|
| 6-123094 | 2/1955 | Japan . |
| 58-29453 | 2/1983 | Japan . |
| 63-98451 | 4/1988 | Japan . |
| 1-97670 | 4/1989 | Japan . |
| 1-249371 | 10/1989 | Japan . |
| 3-32856 | 3/1991 | Japan . |
| 3-258575 | 11/1991 | Japan . |
| 4-120051 | 10/1992 | Japan . |
| 5-147291 | 6/1993 | Japan . |
| 6-79855 | 10/1994 | Japan . |

*Primary Examiner*—Kimberly L. Asher
*Attorney, Agent, or Firm*—Mark P. Watson

[57] ABSTRACT

A roll paper loading mechanism 2 for a printer 1 has a slide frame 25 attached to a cover frame 23, which opens and closes a top opening 22*b*. This cover frame 23 pivots open and closed in conjunction with the opening and closing of a cover frame 28. A platen roller 26 is held on an end of the slide frame 25 in a manner enabling the platen roller 26 to turn. After the top opening 22*b* to the roll paper holding unit is closed by the cover frame 23, the other cover frame 28 can pivot independently. This independent pivoting motion of the cover frame 28 causes the slide frame 25 to slide forward to a position at which the platen roller 26 is positioned to an opposed position with a constant gap to the print head 8. This arrangement increases the sliding distance of the slide frame 25, and thereby reduces the pivot radius needed to fully open the top opening 22*b*. As a result, the area above the top opening 22*b* can be efficiently used to position some other component. A roll paper loading mechanism whereby the opening and closing mechanism for the roll paper holding unit can be compactly configured can thus be provided for a printer.

6 Claims, 8 Drawing Sheets

ROLL PAPER LOADING MECHANISM FOR PRINTER

BACKGROUND OF THE INVENTION

1. Field of the Invention

The present invention relates to a printer used in conjunction with a point-of-sale (POS) terminal where the printer can print to roll paper for issuing receipts, for example. The present invention relates more specifically to a roll paper loading mechanism whereby replacing and loading roll paper rolls in such a printer can be accomplished easily and appropriately.

2. Description of the Related Art

Printers for printing to roll paper are commonly used with POS terminals, and the ability to easily load and replace roll paper in such printers is particularly desirable. Roll paper loading mechanisms for accomplishing this task with the cover of the printer's roll paper holding unit fully open have been proposed. Japan Examined Patent Publication (kokoku) 6-79855, for example, teaches a recording apparatus comprising this type of roll paper loading mechanism.

In the recording apparatus taught in the cited Publication, a platen roller is pressed against a thermal head, and both ends of the platen roller support shaft are held in oblong holes formed near the edge of side support members. These support members are pivotable in conjunction with a cover, which functions as the cover of the roll paper holding unit. Fully opening this cover enables the roll paper to be easily mounted in the roll paper holding unit. Opening the cover also separates the platen roller from the thermal head, thereby enabling the roll paper leader to be easily positioned between the platen roller and thermal head.

When the cover is then closed, engaging members formed on the edges of the cover press both ends of the platen roller support shaft towards the thermal head. Because the ends of the support shaft are supported in oblong holes, this pressure on the shaft ends causes the platen roller to move towards and against the thermal head with the pressure therebetween maintained by a spring supporting the thermal head. As a result, closing the cover automatically results in the roll paper being clamped between the thermal head and platen roller.

Problems such as described below, however, remain to be solved with the roll paper loading mechanism described above.

First, the movement of the platen roller when the cover is closed is determined by the length of the oblong holes in which the platen roller support shaft is supported, and the range of platen roller movement is generally limited when the platen roller is supported in such holes.

When the cover is closed, the edges of the platen roller supports should therefore be as close to the thermal head as possible, and the supports must therefore be made longer than otherwise necessary. Increasing the length of the supports, however, increases the radius of rotation. The top of the roll paper holding unit opening must therefore be opened wide enough to prevent interference with rotation of the platen roller support. This limits the area above this top opening that can be occupied for some other purpose, and thus greatly limits the available design and layout options.

Second, the ends of the platen roller support shaft must be pressed by the engaging members of the cover to press the platen roller against the thermal head. Depending on how each of these engaging members actually engages the shaft ends, different friction loads can be applied to opposite shaft ends, resulting in interference with smooth platen roller rotation.

Third, there are cases in which the platen roller cannot be accurately positioned and pressed against the thermal head by its movement along oblong holes in the support members. For example, if the manufacturing precision of the engaging members is poor, platen roller movement will be different at each end. As a result, the spring-mounted thermal head may not press against the platen roller with appropriate force at all points along the roller, and in extreme cases the thermal head may only contact the platen roller on one side of the thermal head.

This platen roller positioning error does not normally pose a particularly great problem in printers equipped with a spring-mounted thermal head. In printers that use an inkjet head or wire dot impact head, however, the print head to platen roller gap is more critical. More specifically, it is the platen roller or other platen member, including paper guide members functioning as a platen, that determines the distance of the paper from the print head, i.e., the distance from the print head to the surface that is printed on, in this case. It is therefore necessary to position the platen roller or other platen member with a uniform gap to the print head so that the printing surface of the paper is passes the print head with an appropriate gap between the paper surface and the print head. If the position of the platen roller or paper guide varies in a printer having a print head requiring a particular platen gap, problems that cannot be ignored, including print quality deterioration, can occur.

It is, therefore, an object of the present invention is to provide a roll paper loading mechanism for a printer, which is capable of solving the above mentioned problems in the conventional printer.

SUMMARY OF THE INVENTION

To meet the above described needs, the present invention teaches a roll paper loading mechanism for a printer having a roll paper holding unit having an opening for loading a roll paper, a first cover frame capable of pivoting between a closed position whereat said opening is closed and an open position whereat said opening is open, a platen member that moves in conjunction with the first cover frame between an opposed position where the platen member is opposite a print head, and a retracted position where the platen member is separated from the print head. The roll paper loading mechanism comprises a slide frame supported on the first cover frame such that the slide frame can slide in relation to the first cover frame and pivot with the first cover frame; a second cover frame which when pivoted causes the first cover frame and platen member supported on an end of the slide frame to also pivot, and which can pivot independently of the first cover frame after the first cover frame has pivoted to the closed position; and a linkage mechanism for converting the independent pivoting motion of the second cover frame to the sliding motion of the slide frame.

With a roll paper loading mechanism according to the present invention, a slide frame is attached to a first cover frame that pivots with a second cover frame in a manner enabling the slide frame to slide. A platen member is attached to an end of this slide frame. Compared with a sliding mechanism that uses oblong holes, the arrangement of the present invention can easily slide the platen member a greater distance.

In addition, because the platen member is held on the end of the slide frame that slides on an operable cover frame, increasing the sliding distance of the slide frame makes it possible to shorten the length of the slide frame. As a result, the pivot radius of the slide frame can be reduced, and the area above the opening can be effectively used for other components.

The linkage mechanism may preferably comprise a connecting rod fixed to the second cover frame; and a through-hole formed to the slide frame through which the connecting rod passes, and shaped to prevent interference with the independent pivoting motion of the second cover frame.

When the print head is an inkjet head or a wire dot head, the opposed position of the platen member is a position whereat the platen member is held at a uniform distance from the print head.

When the platen member is a platen roller, it is rotatably supported on the slide frame. Compared with an arrangement in which the ends of the platen roller support shaft are held in oblong holes, and the platen roller is slid in those holes, the arrangement of the present invention ensures that the platen roller is always held in a manner allowing the roller to turn smoothly.

Because the ends of the platen roller are held in a fixed position on the slide frame, the platen roller can also be moved with good precision to an opposed position. Positioning precision is also better than what is achieved in arrangements whereby the end supports of the platen roller are moved.

An opposed position defining member for defining the opposed position of the platen member is also preferably provided on the roll paper holding unit side. In this case, the slide frame also preferably comprises a positioning member for contacting the opposed position defining member when the slide frame is slid, said positioning member thereby causing the slide frame to be held in a specific opposed position.

When the first cover frame is then closed after replacing the roll paper, the platen member is consistently and accurately repositioned to a specific opposed position by the opposed position defining member and positioning member. Problems such as poor print quality resulting from an inconsistent gap between the print head and platen can therefore be avoided.

BRIEF DESCRIPTION OF THE DRAWINGS

These and other objects and features of the present invention will be readily understood from the following detailed description taken in conjunction with preferred embodiments thereof with reference to the accompanying drawings, in which like parts are designated by like reference numerals and in which.

DESCRIPTION OF THE PREFERRED EMBODIMENTS

The preferred embodiment of a roll paper loading mechanism for a printer according to the present invention is described below with reference to the accompanying figures.

Overall Configuration of the Printer

Figure 1:
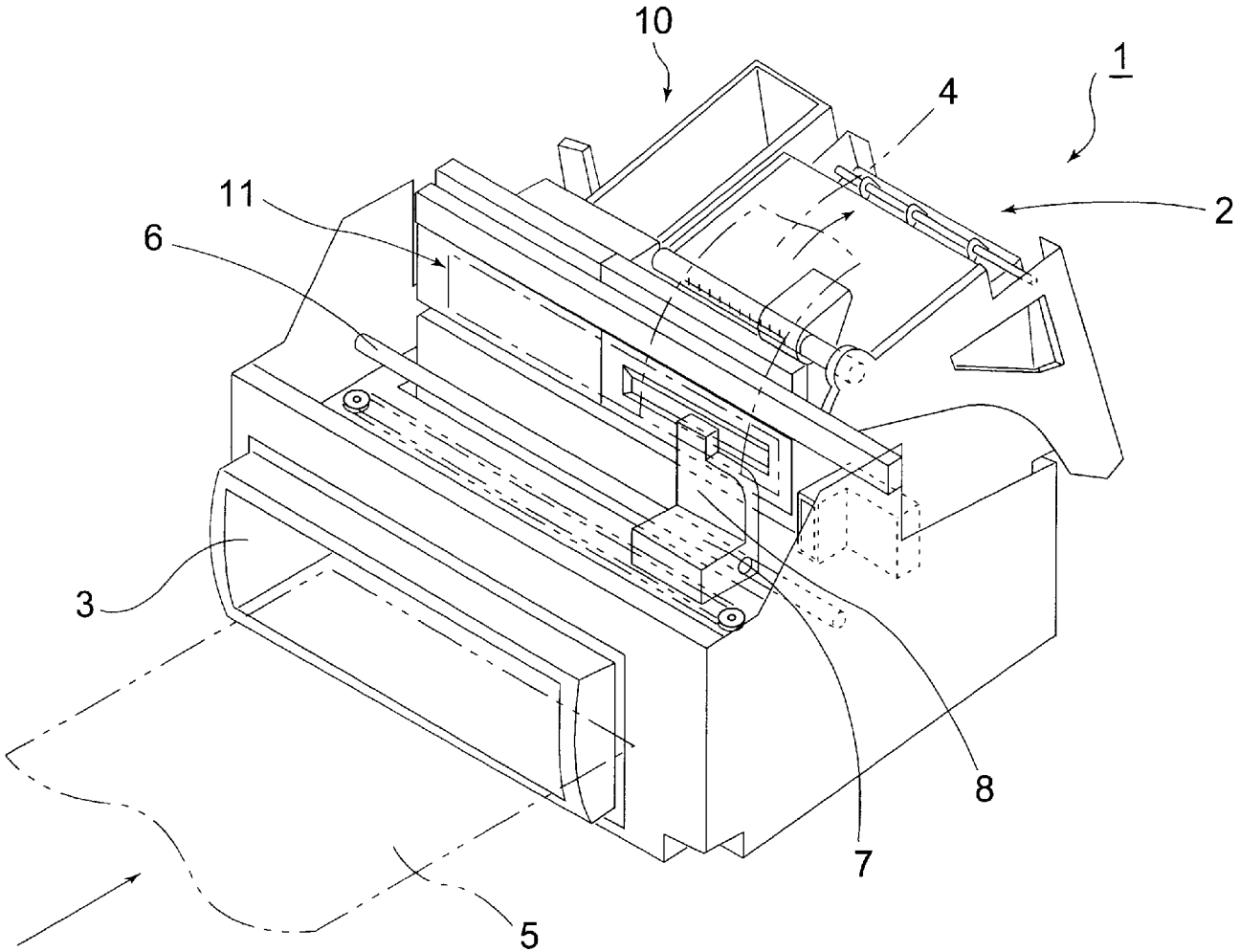
FIG. 1 is a perspective view of an inkjet printer in which a roll paper loading mechanism according to the present invention is used.
Figure 2:
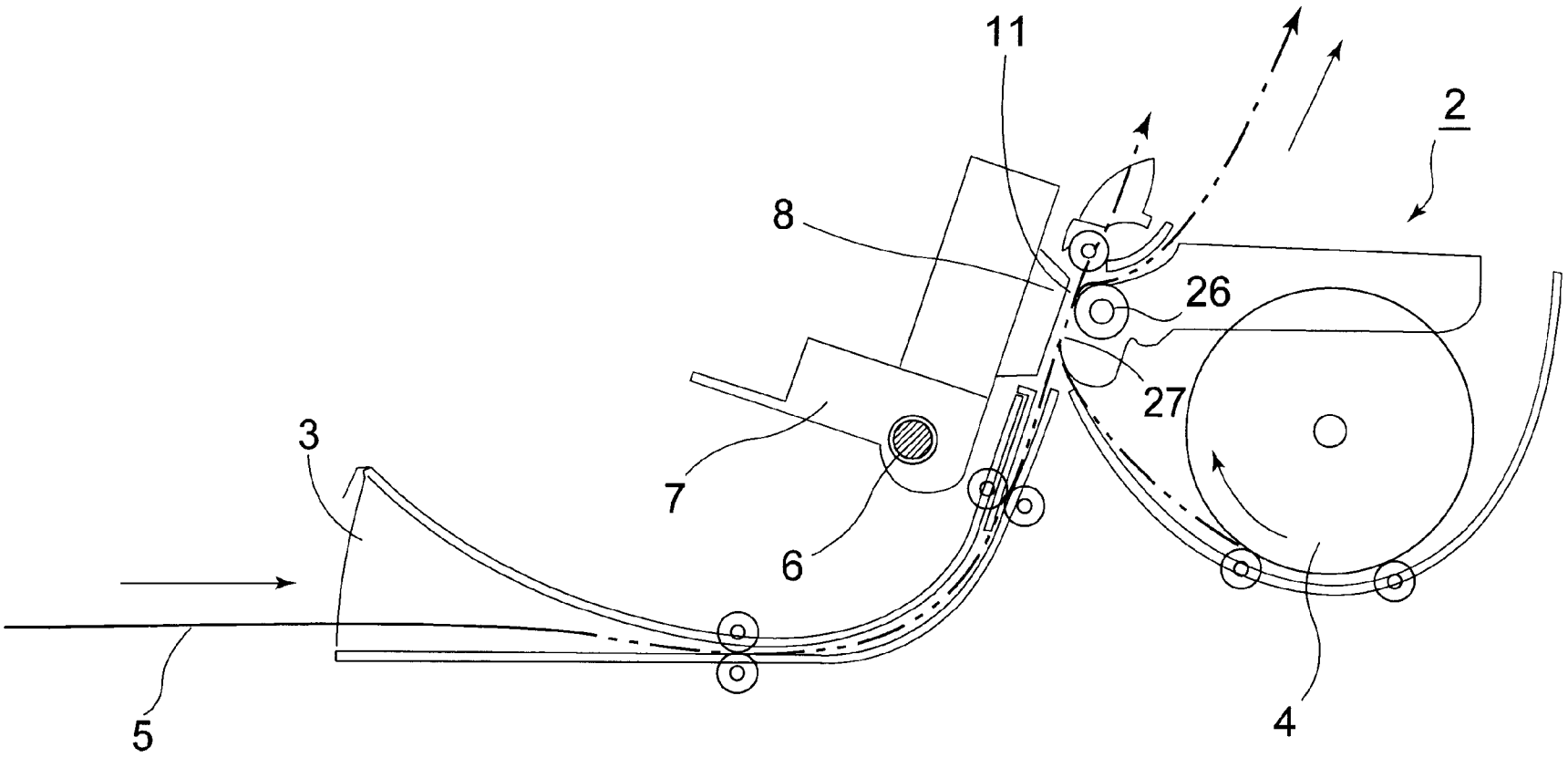
FIG. 2 schematically illustrates a paper transportation path in the inkjet printer shown in FIG. 1.

FIG. 1 is a perspective view of an inkjet printer in which a roll paper loading mechanism according to the present invention is used, and FIG. 2 schematically illustrates a paper transportation path in the inkjet printer shown in FIG. 1.

As will be known from these figures, the inkjet printer 1 comprises a roll paper loading mechanism 2 and a cut-sheet feeder opening 3 for A4 and other size paper. Roll paper 4 supplied from the roll paper loading mechanism 2, and cut form 5 inserted from the cut-sheet feeder opening 3, pass through a paper transportation path configured to guide the paper or other recording medium passed a common printing position 11 (indicated by a dotted line in the figures). Desired content is printed to the surface of the roll paper 4 or cut form 5 passing the printing position 11 using an inkjet head 8, which is mounted on a carriage 7. The carriage 7 travels in two directions along a guide shaft 6. Ink is supplied to the inkjet head 8 from an ink supply reservoir 10 through an ink tube, which is not shown in the figures. The ink supply reservoir 10 is located beside the roll paper loading mechanism 2.

Roll Paper Loading Mechanism

Figure 3:
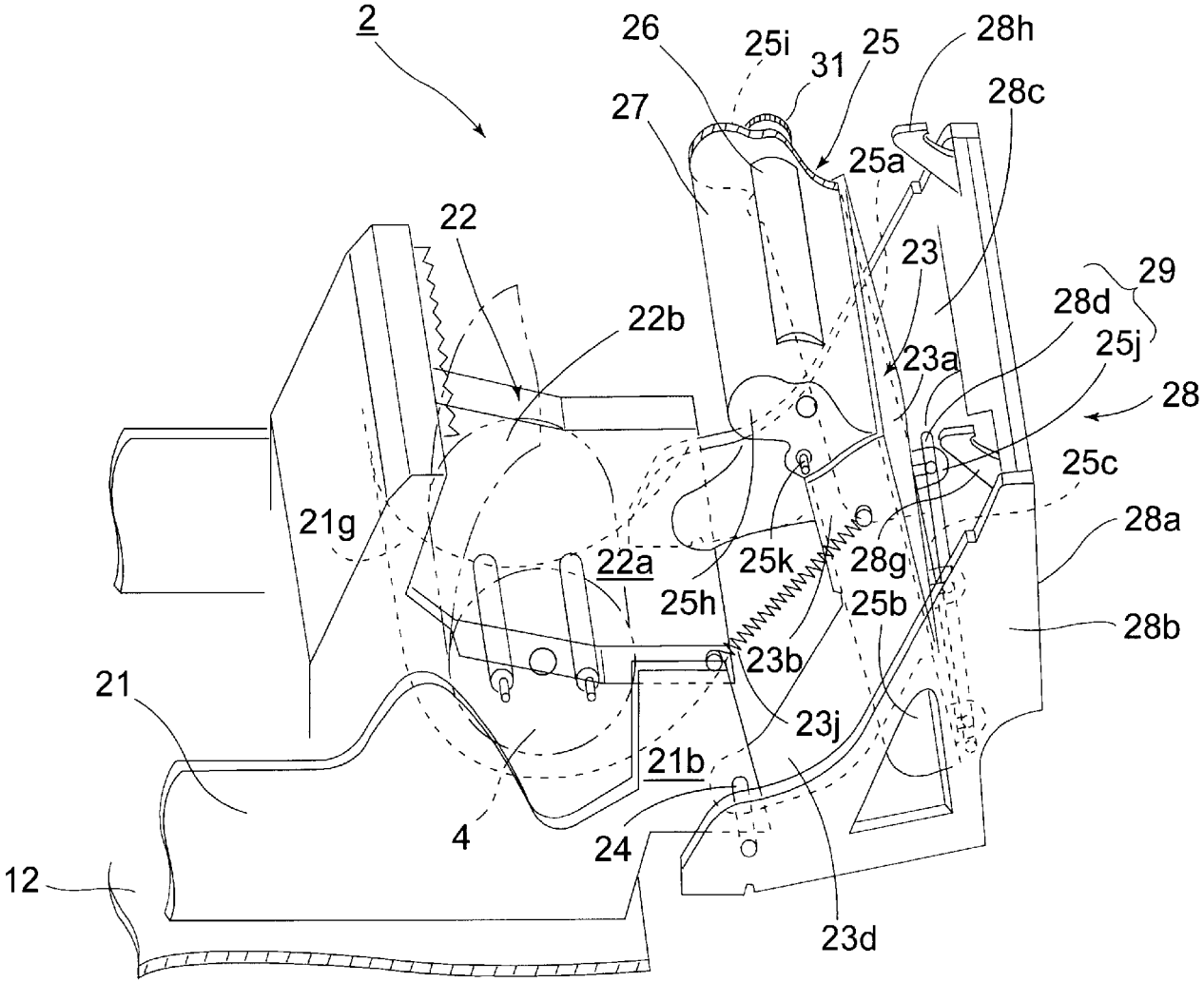
FIG. 3 is a partial perspective view showing the roll paper loading mechanism in the inkjet printer shown in FIG. 1.

FIG. 3 is a partial perspective view showing the roll paper loading mechanism 2 removed from the inkjet printer 1 shown in FIG. 1. FIGS. 4 to 7 are side cross-sections showing the roll paper loading mechanism 2 at various stages in the opening and closing of the roll paper holding unit, and FIGS. 8A and B show a part of the roll paper holding unit.

Referring to these various figures, the roll paper loading mechanism 2 comprises a mounting frame 21 whereby the roll paper loading mechanism 2 is mounted to the main printer frame 12. A roll paper holding unit 22 into which the roll paper 4 is loaded is disposed to the mounting frame 21.

The roll paper holding unit 22 comprises a semicircular curved part 22*a* with a constant width, and a rectangular opening 22*b* formed above the curved part 22*a*. Roll paper 4 is loaded to the roll paper holding unit 22 from this rectangular opening 22b.

Figure 4:
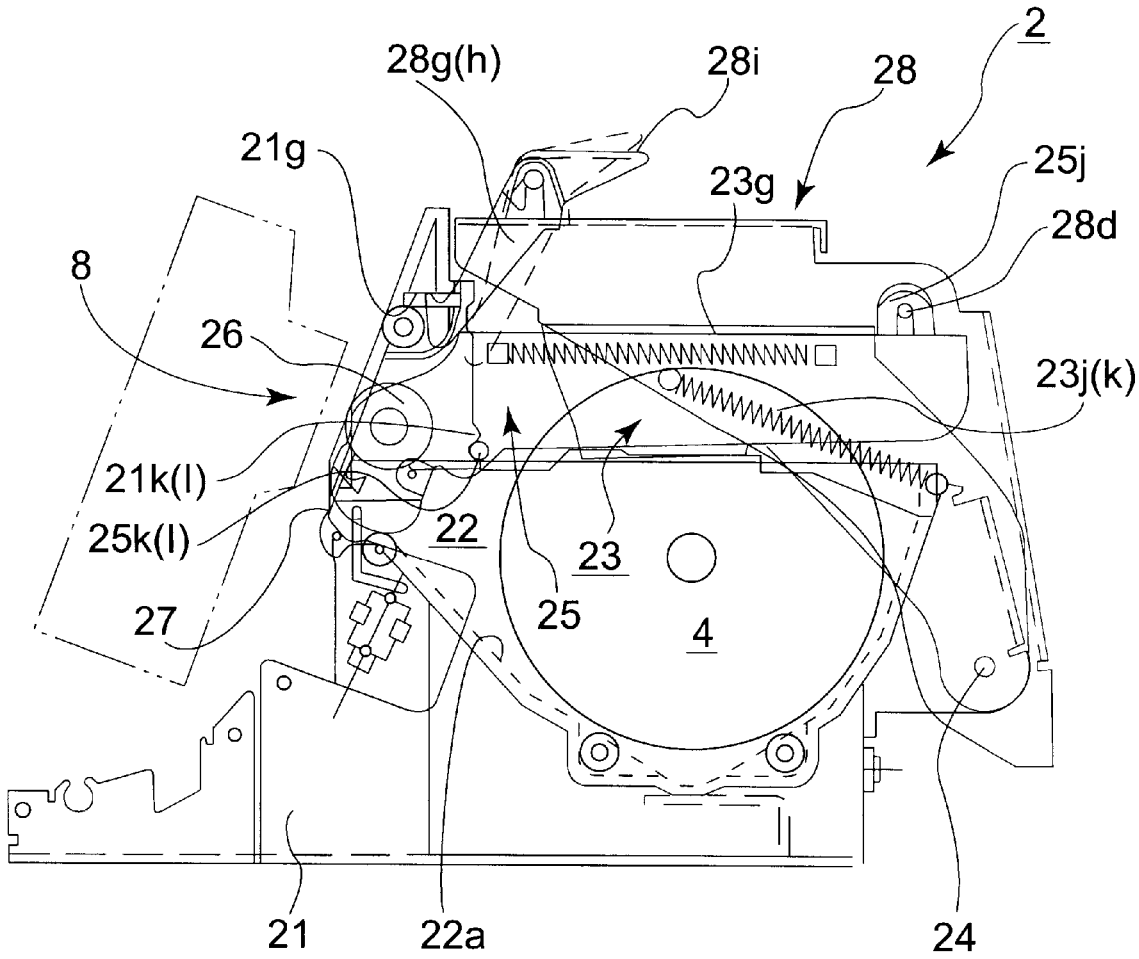
FIG. 4 is a side cross-section showing the roll paper holding unit of the roll paper loading mechanism shown in FIG. 3 closed.
Figure 7:
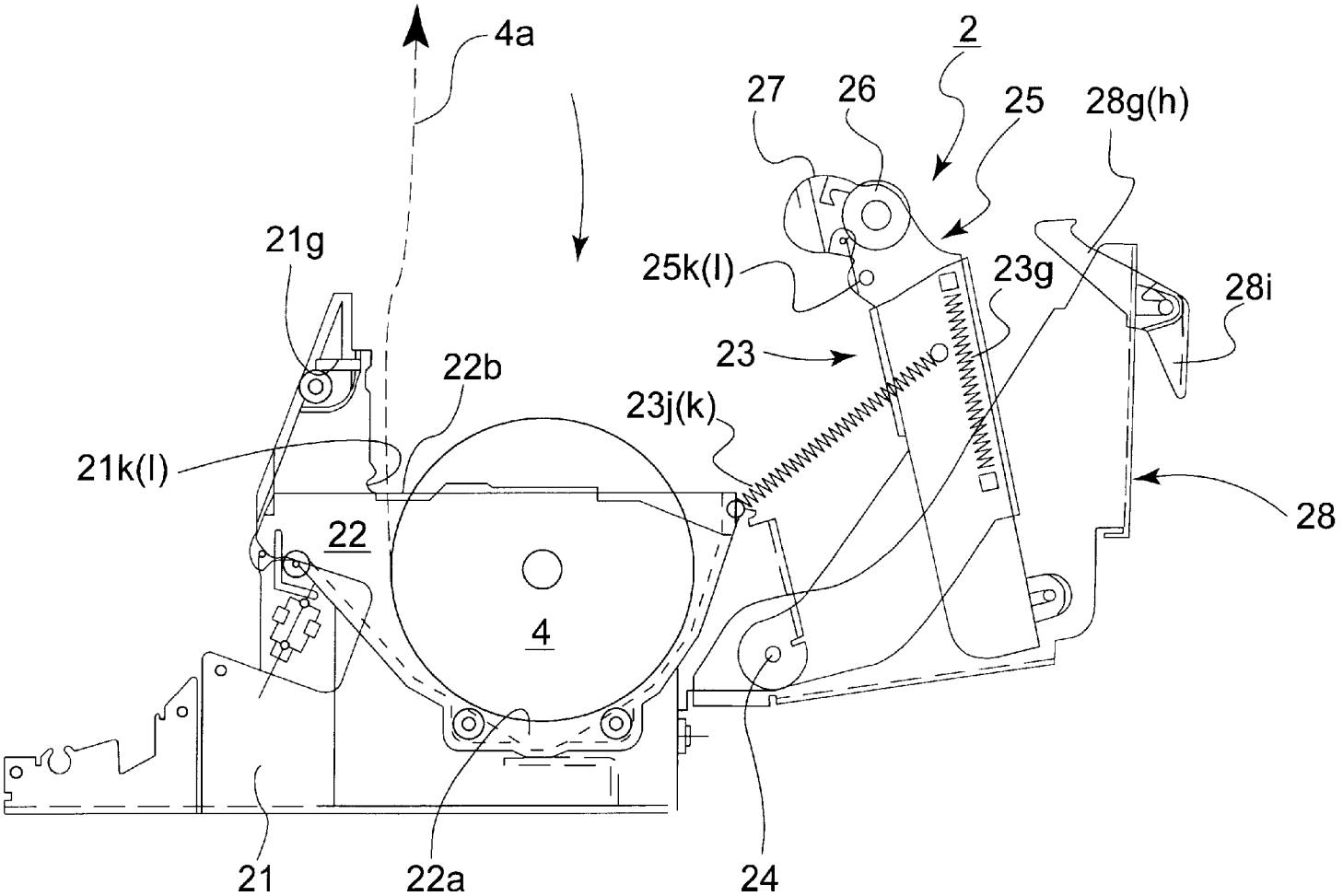
FIG. 7 is a side cross-section showing the roll paper holding unit of the roll paper loading mechanism shown in FIG. 3 fully open.

The rectangular opening 22*b* can be opened and closed by means of a cover frame 23. The cover frame 23 comprises a rectangular top plate 23*a* with substantially the same shape as the rectangular opening 22*b*, and side members 23*b* and 23*c*. The side members 23*b* and 23*c* have a fixed height, and are bent downward perpendicularly to the right and left sides of the top plate 23*a*. The back parts of the side members 23*b* and 23*c* as seen in FIG. 3 curve further downward, forming bottom ends 23*d* and 23*e* (only bottom end 23*d* being shown in FIG. 3). The cover frame 23 is pivotably supported around a shaft 24 disposed at bottom ends 23*d* and 23*e*. The cover frame 23 can thus pivot on shaft 24 between a closed position and an open position,. When in the closed position, the opening 22*b* through which roll paper 4 is inserted to the roll paper holding unit 22 is closed, as shown in FIG. 4. When in the open position, the opening 22*b* is fully open, as shown in FIG. 7.

A slide frame 25 is also mounted to this cover frame 23. The slide frame 25 pivots with the cover frame 23 and slides in relation to the cover frame 23. A platen roller 26 and a paper guide 27 for guiding the roll paper 4 to the platen roller 26 are attached at the front end of the slide frame 25.

The means whereby the slide frame 25 is mounted to enable movement relative to the cover frame 23 is described immediately below with reference to FIG. 8.

Figure 8A:
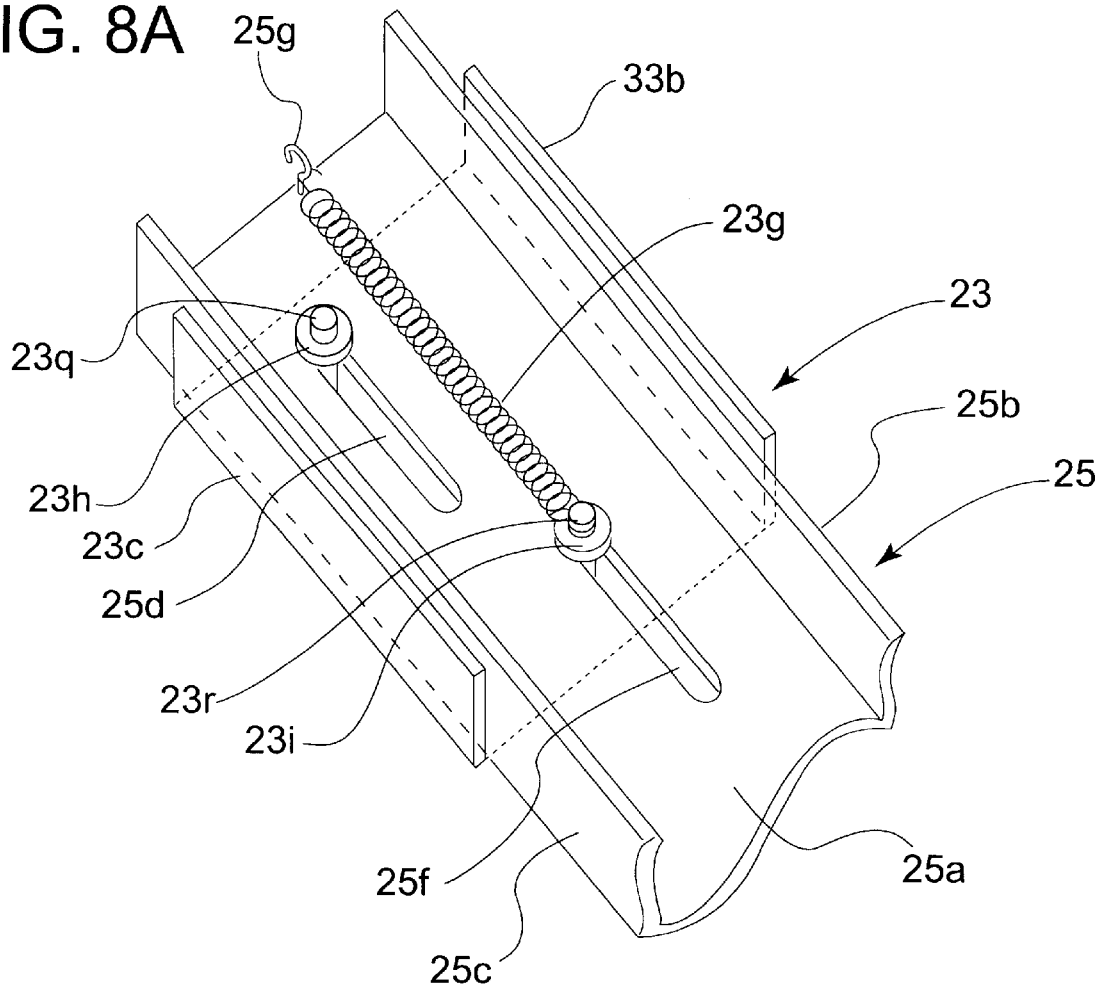
FIGS. 8A and B show the installation of a slide frame to a cover frame of the roll paper loading mechanism shown in FIG. 3.
Figure 8B:
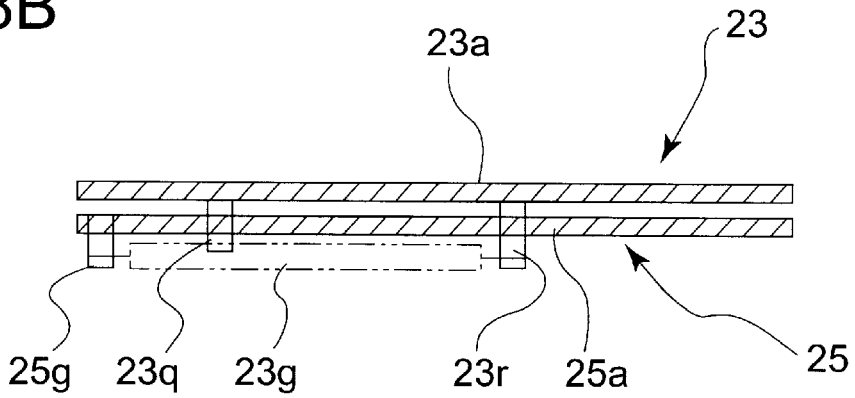

As shown in FIG. 8A, the slide frame 25 comprises a rectangular top panel 25*a*, and side panels 25*b* and 25*c*. The top panel 25*a* is substantially in contact with the bottom side of the top plate 23*a* of the cover frame 23 as shown in FIG. 8B. The side panels 25*b* and 25*c* are bent downward perpendicularly from both sides of the top panel 25*a*, and have a uniform height. Note that FIG. 8A shows the cover frame 23 and slide frame 25 upside down.

Longitudinal guide slots 25*d* and 25*f* formed in the top panel 25*a* engage guide pins 23*q* and 23*r*, which are fixed to the surface of cover frame top plate 23*a*. Lock rings 23*h* and 23*i* attached to the bottom end of the guide pins 23*q* and 23*r* hold the slide frame 25 to the cover frame 23, and enable the slide frame 25 to slide along the back (bottom) side of the cover frame 23 when in the normal operating position.

A coil spring 23*g* is connected between guide pin 23*r* on the back side of the cover frame 23, and a spring catch 25*g* formed toward the front of the slide frame 25. The tension of coil spring 23*g* constantly urges slide frame 25 toward the back.

As will also be known from FIG. 3, platen roller 26 is disposed between the front ends 25*h* and 25*i* of the slide frame side panels 25*b* and 25*c* with the ends of the platen roller support shaft rotationally supported by front ends 25*h* and 25*i*. The surface of paper guide 27 formed below the platen roller 26 is a convex curve such that roll paper 4 is guided tangentially to the surface of the platen roller 26.

Figure 5:
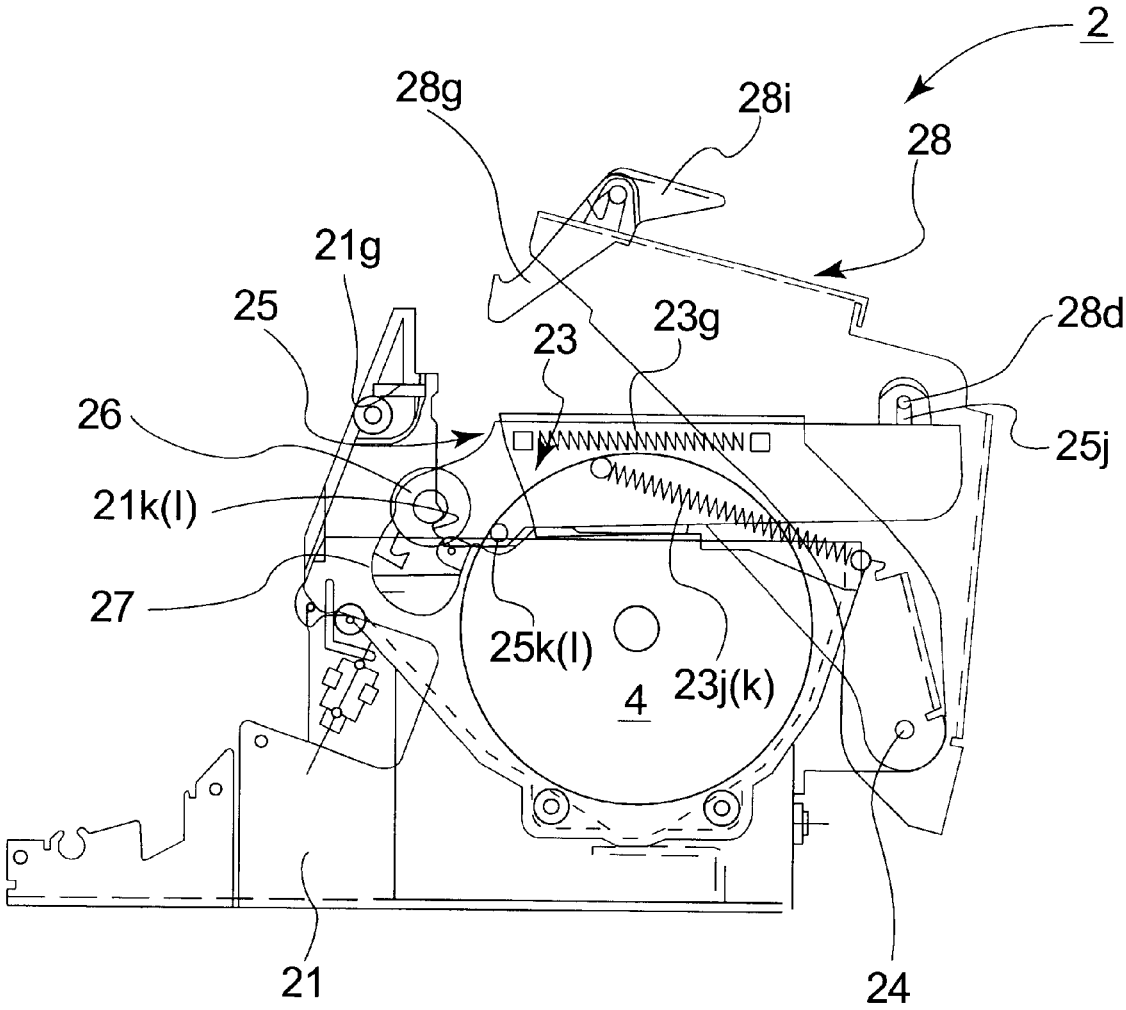
FIG. 5 is a side cross-section the showing the roll paper holding unit of the roll paper loading mechanism shown in FIG. 3 after the cover frame lock has been released.

A cover frame 28 somewhat larger than the cover frame 23 is disposed above cover frame 23. This cover frame 28 similarly comprises a top plate 28*a* and side members 28*b* and 28*c*, which are similarly bent downward perpendicularly from the sides of the top plate 28*a*. The bottom back ends of the side members 28*b* and 28*c* also extend downward and are pivotably supported on the shaft 24. Rotating this cover frame 28 on the shaft 24 causes the cover frame 23 with the slide frame 25 attached thereto to also pivot. When rotated to the closed position, the cover frame 28 continues moving independently of the cover frame 23 after the cover frame 23 has covered and closed the top opening 22*b* as shown in FIG. 5.

Movement of cover frame 28 independently of the cover frame 23 is accompanied by the slide frame 25 sliding longitudinally to the cover frame 23.

The linkage mechanism 29 whereby the independent rotational movement of the cover frame 28 is converted to the sliding movement of the slide frame 25 comprises a connecting rod 28*d* and three connecting holes 25*j*. The connecting holes 25*j* are formed at three discrete points at the back of the slide frame 25. The connecting rod 28*d* passes through the connecting holes 25*j* and connects the side members 28*b* and 28*c* of the cover frame 28 at a top back part thereof. To prevent interference with the independent pivoting movement of the cover frame 28, the connecting holes 25*j* have a vertically oblong shape. Because of this arrangement, the position of the connecting rod 28*d* moves downward and forward relative to the axis of the shaft 24 around which the cover frames 23 and 28 pivot when the cover frame 28 is rotated beyond the position shown in FIG. 5 whereat the cover frame 23 is closed over the top opening 22*b* to a horizontal orientation as shown in FIG. 4.

The connecting rod 28*d* can thus move freely downward at this time in the vertically oblong connecting holes 25*j* while also pushing forward on the connecting holes 25*j*. As a result, the slide frame 25 to which the connecting holes 25*j* are formed is pushed forward. That is, the slide frame 25 is slid forward relative to the cover frame 23, thus pushing the platen roller 26 and paper guide 27 disposed at the front end of the slide frame 25 forward (into the paper path) to the printing position 11 opposite the inkjet head 8. When this sliding movement stops, the platen roller 26 is positioned with a uniform gap to the inkjet head 8. This is referred to as the "opposed position" below.

When the cover frame 28 is pivoted from the horizontal position shown in FIG. 4 to the raised position shown in FIG. 5, the action described above is reversed. That is, the overall slide frame 25 slides to the back away from the printing position 11 and paper path, thereby causing the platen roller 26 and paper guide 27 to move from the opposed position to a retracted position.

As described above, the slide frame 25 is constantly urged toward the retracted position by the tension of a coil spring 23*g*. Therefore, when the force holding the cover frame 28 is released after closing the cover frame 28 to the horizontal position shown in FIG. 4, the force of the coil spring 23*g* causes the slide frame 25 to return to the retracted position. The cover frame 28 also pivots to the open position in conjunction with this sliding action, and thus returns to the position shown in FIG. 5.

A pair of engaging claws 28*g* and 28*h* for locking the cover frame 28 in the closed position shown in FIG. 4 is provided near the front edge of the cover frame 28. An opposing engaged part 21*g* is formed on a front edge part of the mounting frame 21 opposite the hooks formed on the ends of these engaging claws 28*g* and 28*h*. As a result, when the cover frame 28 is rotated closed, the hooks on the engaging claws 28*g* and 28*h* rotate down and catch the engaged part 21*g* from below. The engaging claws 28*g* and 28*h* are constantly urged by a torsion spring (not shown in the figures) in an upwardly rotating direction.

Therefore, when the cover frame 28 is depressed from the closed position shown in FIG. 4, the engaging claws 28*g* and 28*h* pivot slightly in the direction resisting the upward force of the torsion spring. The hooks on the bottom ends thereof thus engage from below the engaged part 21*g* formed on the mounting frame 21 side, and the cover frame 28 is locked in position. To release this lock, a top arm 28*i* on the engaging claws 28*g* and 28*h* is simply lifted, thereby causing the hooks on the opposite end to rotate downward and release the engaged part 21*g*.

Note that coil springs 23*j* and 23*k* (only spring 23*j* is shown in the figures) are disposed between side members 23*b* and 23*c* of the cover frame 23 and side members 21*b* and 21*c* (only side member 21*b* is shown in FIG. 3) of the mounting frame 21. The coil springs 23*j* and 23*k* are positioned such that when the cover frame 28, slide frame 25, and cover frame 23 are opened on shaft 24, the path traced by the spring mounts on both ends of the springs widens after the center of gravity of these parts pivots to a position directly above the shaft 24 as shown in FIG. 6.

Figure 6:
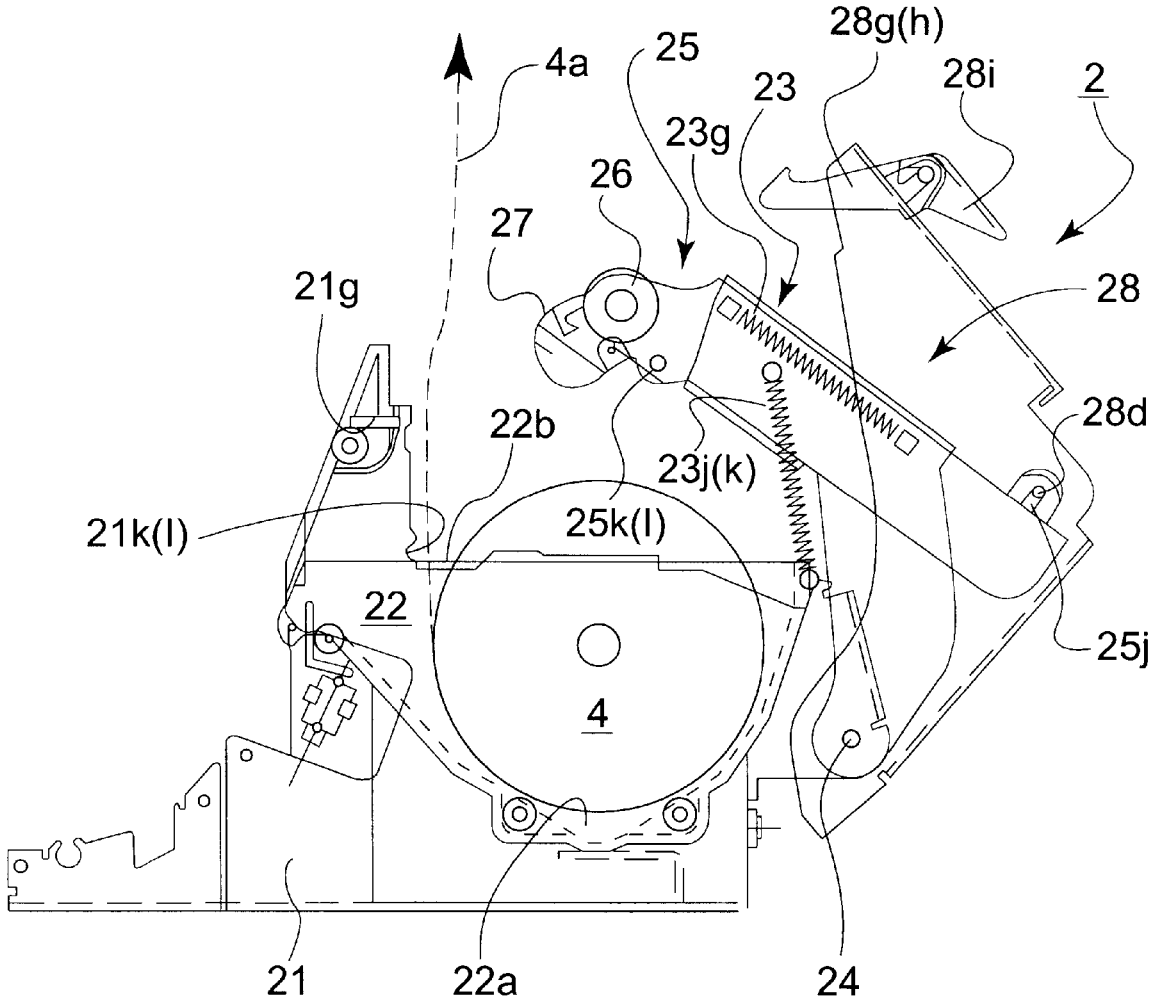
FIG. 6 is a side cross-section showing the cover frame of the roll paper loading mechanism shown in FIG. 3 opened to a nearly vertical position.

The coil springs 23*j* and 23*k* are therefore stretched when the cover frame 28 is opened beyond the position shown in FIG. 6, and the resulting spring tension urges the cover frame 28 closed. This spring tension prevents the cover frame 28 from opening with excessive force, and thus prevents impact damage to other parts.

When the cover frame 28 is then closed from the position shown in FIG. 6, the coil springs 23*j* and 23*k* prevent the cover frame 28 from closing with excessive force, and thus prevent impact with the top opening 22*b* and the damage resulting therefrom.

Platen Roller Positioning Mechanism

As described below, the roll paper loading mechanism 2 according to the present embodiment comprises a mechanism for determining with good precision the position (the opposed position) of the platen roller 26 at the end of the slide frame 25 when the cover frame 28 is closed as described above. That is, a positioning pin 25*k* and 25*l* (only positioning pin 25*k* is shown in FIG. 3) is provided projecting horizontally to the outside at a front edge of each slide frame side panel 25*b* and 25*c*.

Matching semicircular notches 21*k* and 21*l* are provided in a part of the mounting frame 21 opposite the positioning pins 25*k* and 25*l* when the slide frame 25 is closed. When the slide frame 25 is then closed, the positioning pins 25*k* and 25*l* are seated from the side into the matching notches 21*k* and 21*l*.

The notches 21*k* and 21*l* are formed at a fixed positioned in relation to the printing position 11. As a result, seating the slide frame positioning pins 25*k* and 25*l* in the matching notches 21*k* and 21*l* consistently precisely positions the platen roller 26 on the end of the slide frame 25 in the opposed position.

In other words, these notches 21*k* and 21*l* function as defining members for defining the precise opposed position of the platen roller 26, and the positioning pins 25*k* and 25*l* on the slide frame 25 side function as positioning members that slide into contact with the matching notches 21*k* and 21*l*.

This platen roller positioning mechanism thus ensures that even if the platen roller 26 is moved on the end of the slide frame 25 when replacing the roll paper 4, closing the cover frame 28 after loading the new roll returns the platen roller 26 consistently to a specified position. As a result, a uniform gap between the outside surface of the platen roller 26 and the nozzle face of the inkjet head 8 traversing a path in front of the platen roller 26 can be consistently and reliably maintained.

Operation of the Roll Paper Loading Mechanism

The opening and closing operation of the roll paper holding unit 22 in the roll paper loading mechanism 2 of the present embodiment is described next below with reference to FIG. 4 to FIG. 7.

Referring first to FIG. 4, the closed roll paper holding unit 22 is opened by lifting up on the top arm 28*i* linked to the engaging claws 28*g* and 28*h*. This causes the engaging claws 28*g* and 28*h* to separate from the engaged part 21*g* of the mounting frame 21, and thus releases the lock. Once released, the cover frame 28, slide frame 25, and cover frame 23 pivot open as one unit to the position shown in FIG. 5. This pivoting action is driven primarily by the tension of the coil spring 23*g* stretched between the slide frame 25 and cover frame 23.

When the cover frame 28 is then rotated further to the back (to the right as seen in FIG. 5) against the tension of coil springs 23*j* and 23*k*, the assembly moves through the position shown in FIG. 6 to the position shown in FIG. 7 whereat the top opening 22*b* to the roll paper holding unit 22 is fully open. That is, the cover frame 28, slide frame 25, and cover frame 23 are moved to a position fully retracted from above the top opening 22*b*.

Once the roll paper holding unit 22 is thus fully open, the roll paper 4 loaded in the curved part 22*a* of the roll paper holding unit 22 is replaced. This operation is also easy to accomplish because the top opening 22*b* is wide open. It is also easy to correctly position the leader 4*a* from the roll paper 4 because the platen roller 26, paper guide 27, and slide frame 25 are also retracted from the opening.

After loading the roll paper 4, the cover frame 28 is then rotated in the closing direction. The cover frame 28, slide frame 25, and cover frame 23 again move together, passing through the position shown in FIG. 6 to the position shown in FIG. 5 whereat the cover frame 23 has closed the top opening 22*b*. The cover frame 23 then engages the edge of the top opening 22*b*, and can rotate no farther. The slide frame 25, which can slide independently on the cover frame 23, can also pivot no farther. As a result, only the cover frame 28 remains free, and can continue closing independently of the cover frame 23 and slide frame 25.

As the cover frame 28 is rotated further and closed to the position shown in FIG. 4, the linkage mechanism 29 converts the rotating motion of the cover frame 28 to the sliding motion of the slide frame 25. This causes the slide frame 25 to slide forward in relation to the cover frame 23 to the fixed opposed position in which the platen roller 26 and paper guide 27 are held with a specified gap to the inkjet head 8.

When the slide frame 25 slides forward and the platen roller 26 reaches the opposed position, the positioning pins 25*k* and 25*l* at the end of the slide frame 25 fit precisely into the notches 21*k* and 21*l* in the mounting frame 21. Sliding thus stops and the slide frame 25, platen roller 26, and paper guide 27 are secured in the opposed position with a specified gap to the inkjet head 8.

It should be noted that the driven gear 31 linked to one end of the platen roller 26 meshes with a drive gear (not shown in the figures) provided on the mounting frame 21 when the platen roller 26 is thus positioned. When the drive gear then turns, the platen roller 26 turns, the leader 4*a* of the roll paper 4 is advanced in the transportation direction (direction of the arrow), and the inkjet head 8 is driven to print synchronized to this operation.

Alternative Embodiments

It will be obvious to those skilled in the art that while the above exemplary embodiment of the invention uses an inkjet printer by way of example, the present invention shall not be so limited. More specifically, the present invention is suitable for use with printers using a variety of print heads, including inkjet heads, wire dot print heads, and thermal print heads.

The inkjet printer described above is also configured for printing to both roll paper and cut-sheet forms. It will be equally obvious, however, that the present invention is also suited to printers used in point-of-sale (POS) terminals that typically print only to roll paper.

As described above, the roll paper loading mechanism for a printer according to the present invention provides a slide frame on a cover frame whereby the opening to a roll paper holding unit is opened and closed. This slide frame is configured such that a rotational movement of the cover frame causes the slide frame to slide. This sliding motion moves a platen member supported on an end of the slide frame to an opposed position where a specified gap to the print head is maintained, and from this opposed position to a retracted position where the platen member is retracted from the print head.

This arrangement makes it simple to slide the platen roller or other platen member a greater distance than is possible with a typical conventional arrangement in which the ends of the platen roller support shaft are supported in oblong holes, and the platen roller is slid along those holes.

A short cover frame can therefore be used to support the slide frame. Using a short cover frame also reduces the turning radius needed to open and close the cover. A greater space is therefore made available above the top opening in the roll paper holding unit for locating other components. As a result, the arrangement of the present invention provides a greater degree of freedom in the design and layout.

The ends of the platen roller are also rotationally supported in a fixed position at the end of the slide frame, and unlike the platen roller support members in a conventional arrangement, the supports for the platen roller ends cannot slide. Smooth platen roller rotation is thereby assured because the platen roller ends are supported in a consistently appropriate position. Other problems that tend to occur when the platen roller can slide are also avoided. These problems include the position of the platen roller changing as a result of platen roller movement (sliding), and lopsided contact between the platen roller and thermal head resulting from inconsistent positioning of the platen roller ends.

The platen member can also be held with good precision to a defined opposed position when the roll paper holding unit is closed because of the opposed position defining members that are provided on the roll paper holding unit side for defining the precise opposed position of the platen member. This also avoids problems associated with an unreliable platen gap, including a loss of print quality resulting from an inconsistent or inappropriate platen gap.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper loading mechanism for a printer comprising:

a roll paper holding unit including an opening for loading a roll paper;

a first frame pivotally supported on said roll paper holding unit for pivotal movement between a closed position where said opening is closed and an open position where said opening is open;

a slide frame supported on said first frame to slide in relation to said first frame and to rotate with said first frame;

a platen member supported on an end of said slide frame to move in conjunction with said slide frame between an opposed position where said platen member is opposite a print head, and a retracted position where said platen member is separated from said print head;

a second frame pivotally supported on said roll paper holding unit for pivotal movement, said second frame connected to said slide frame; and a linkage mechanism converting said pivotal movement of said second frame to a sliding movement of said slide frame when said first frame is positioned at said closed position.

2. The roll paper loading mechanism as set forth in claim 1, wherein said linkage mechanism comprises a connecting rod fixed to said second frame; and said slide frame comprises a through-hole through which said connecting rod passes, said through-hole having an elongated shape.

3. The roll paper loading mechanism as set forth in claim 1 or 2, wherein said print head comprises one of an inkjet head and a wire dot head; and wherein said opposed position of said platen member is a position where said platen member is positioned along its length at a uniform distance from said print head.

4. The roll paper loading mechanism as set forth in claim 1 or 2, wherein said platen member comprises a platen roller rotatively supported on said slide frame.

5. The roll paper loading mechanism as set forth in claim 1 or 2, wherein said roll paper holding unit comprises an opposed position defining member, and said slide frame comprises a positioning member contacting said opposed position defining member when said slide frame is slid, said positioning member thereby locating said slide frame in said opposed position.

6. The roll paper loading mechanism as set forth in claim 1, wherein said roll paper holding unit comprises a pivot, and wherein said first frame and said second frame are supported on said pivot.

* * * * *

UNITED STATES PATENT AND TRADEMARK OFFICE

CERTIFICATE OF CORRECTION

| | | |
|---|---|---|
| PATENT NO. | : | 6,022,158 |
| DATED | : | February 08, 2000 |
| INVENTOR(S) | : | Hiroyuki Nakayama, et al. |

It is certified that errors appear in the above identified patent and that said Letters Patent is hereby corrected as shown below:

Title page, item 54, title, change "For Printer" to --For A Printer--.

Column 10, line 24, change "wherein said" to --comprising a-- and "comprises" to --comprising--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*